US006536577B2

(12) United States Patent
Ishida et al.

(10) Patent No.: US 6,536,577 B2
(45) Date of Patent: Mar. 25, 2003

(54) COIN HANDLING METHOD AND DEVICE

(75) Inventors: Takeshi Ishida, Tokyo (JP); Tsunehiro Aso, Tokyo (JP); Kenji Koyama, Tokyo (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 137 days.

(21) Appl. No.: 09/795,989

(22) Filed: Feb. 28, 2001

(65) Prior Publication Data

US 2001/0023809 A1 Sep. 27, 2001

(30) Foreign Application Priority Data

Mar. 22, 2000 (JP) ..... 2000-080794
Mar. 22, 2000 (JP) ..... 2000-080795
Mar. 22, 2000 (JP) ..... 2000-080796

(51) Int. Cl.[7] ..... G07F 9/08
(52) U.S. Cl. ..... 194/217
(58) Field of Search ..... 194/215, 216, 194/217, 219, 230

(56) References Cited

U.S. PATENT DOCUMENTS 3,948,377 A 4/1976 Hayashi et al.
4,347,924 A * 9/1982 Hayashi et al. ..... 194/346
4,499,985 A * 2/1985 Schuller ..... 194/217
5,607,350 A * 3/1997 Levasseur et al. ..... 453/17
5,988,347 A * 11/1999 Schwab ..... 194/217

FOREIGN PATENT DOCUMENTS

JP 57-17091 1/1982
JP 7-114660 2/1995
JP 7-141540 2/1995

* cited by examiner

*Primary Examiner*—Donald P. Walsh
*Assistant Examiner*—Mark J Beauchaine
(74) *Attorney, Agent, or Firm*—Welsh & Katz, Ltd.

(57) ABSTRACT

A coin handling method and a device which can prevent functions from being degraded by adoption of an escrow mechanism in order to temporarily hold a plurality of inserted coins to provide convenience and to prevent counterfeit coins from being used and also to provide a normal operation even if any coins are temporarily held at the time when the power is turned on. The inserted coins are temporarily held in an escrow passage, the number of temporarily held coins can be determined arbitrarily, and the coins inserted not less than the determined number are returned by an operation of a authentic/counterfeit sorting lever in order to return the inserted coin. And, to collect coins, a return passage lever and a coin box passage lever are operated depending on the states of respective portions so to guide the coins temporarily held in the escrow passage to a coin tube, a return passage or a coin box passage. At the time when the power is turned on, the coin box passage lever is switched toward the coin box passage, and an escrow pin is operated to guide the coins in the escrow passage to the coin box.

33 Claims, 11 Drawing Sheets

COIN HANDLING METHOD AND DEVICE

BACKGROUND OF THE INVENTION

1. Field of the Invention

The invention relates to a coin handling method and a device, and more particularly to a coin handling method and a device which can temporarily hold a plurality of coins and return the inserted coins when a return operation is performed.

2. Description of the Related Art

Automatic vending machines are generally provided with a coin handling device for accepting coins and dispensing change.

A conventional coin handling device identifies the inserted coins as authentic or counterfeit and denominations, stores the authentic coins in coin tubes corresponding to respective denominations, and dispenses the coins corresponding to an amount of change to be dispensed. According to the above structure, when the inserted coins are to be returned for some reason, the coins corresponding to the inserted coins are dispensed from the coin tubes. Therefore, the returned coins are the same denominations as those of the inserted coins but not the inserted coins.

Therefore, there are many crimes that counterfeit coins are put into an automatic vending machine and a refund operation is made to get authentic coins. To deal with such crimes, the inserted coins can be closely identified as authentic or counterfeit, but the authentic coins may be identified as counterfeit if they are damaged or contaminated by such close identification, and the use of the vending machines has become inconvenient.

In view of the above circumstances, to prevent the use of counterfeit coins and to secure the convenience, there are used coin handling devices which are provided with a temporarily holding mechanism (escrow mechanism) for temporarily holding (escrowing) the inserted coins and return the actually inserted coins when a refund operation is made.

As described above, there have been used the coin handling devices having the escrow mechanism lately. Meanwhile, the automatic vending machines and the like provided with the coin handling device are increasing to vend high-priced commodity products, and the coin handling device is desired to be able to hold temporarily a plurality of coins for the convenience of the automatic vending machines.

Besides, the coin handling devices having the escrow mechanism may have its operation jammed, an automatic change adjusting function (which keeps the number of coins dispensable as change at a constant level) disabled or the like by the temporarily held coins which are left as they are if the power is cut off due to a power failure or the like and turned on again.

SUMMARY OF THE INVENTION

Accordingly, it is an object of the present invention to provide a coin handling method and a device which can prevent functions from being degraded by adoption of an escrow mechanism in order to temporarily hold a plurality of inserted coins to provide convenience and to prevent counterfeit coins from being used and also to provide a normal operation even if any coins are temporarily held at the time when the power is turned on.

In order to achieve the above object, the invention of claim 1 is a coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein:

the denominations and number of coins to be temporarily held in the temporarily holding mechanism are previously determined; and when coins of the predetermined denominations are inserted in the predetermined number, the inserted coins are returned without being temporarily held in the temporarily holding mechanism.

The invention of claim 2 is the invention of claim 1, wherein the number of coins temporarily held is determined arbitrarily within a range of the temporarily holdable number of coins in the temporarily holding mechanism.

The invention of claim 3 is the invention of claim 2, wherein if at least one of the coins temporarily held in the temporarily holding mechanism is accommodated, coins of the pertinent denomination newly inserted within the range of the predetermined number of coins can be temporarily held in the temporarily holding mechanism.

The invention of claim 4 is a coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein:

when the accommodation instruction is given, the held coins are selectively sorted and accommodated into a coin box for recovering coins or a coin tube for accommodating coins to be dispensed.

The invention of claim 5 is the invention of claim 4, wherein the coins temporarily held in the temporarily holding mechanism are sorted to the coin tube if the number of coins accommodated in the coin tube is less than an allowable number and sorted to the coin box if the number of coins accommodated in the coin tube is not less than the allowable number.

The invention of claim 6 is the invention of claim 5, wherein the coins temporarily held in the temporarily holding mechanism are sorted to the coin tube if the number of coins accommodated in the coin tube is less than a predetermined number and sorted to the coin box if the number of coins accommodated in the coin tube is not less than the predetermined number.

The invention of claim 7 is the invention of claim 5, wherein the coins have a plurality of types in the same denomination; and if the coins temporarily held in the temporarily holding mechanism are those of predetermined types, they are sorted to the coin box regardless of the number of coins accommodated in the coin tube.

The invention of claim 8 is the invention of claim 4, wherein the coins temporarily held in the temporarily holding mechanism are released and sorted one by one from the held state.

The invention of claim 9 is the invention of claim 4, wherein when the accommodation instruction is issued about some of the coins temporarily held in the temporarily holding mechanism, the coins related to the accommodation instruction are accommodated and the other coins are returned.

The invention of claim 10 is the invention of claim 9, wherein the coins have a plurality of types in the same denomination; and coins of predetermined types are accommodated with a high priority among the coins of the plurality of types.

The invention of claim 11 is a coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein if a predetermined event takes place, an operation of releasing the coins temporarily held in the temporarily holding mechanism is performed at least one time.

The invention of claim 12 is the invention of claim 11, wherein the event is an initializing process including a power turning-on time, and the coins temporarily held in the temporarily holding mechanism are guided to a coin box for recovering coins by the releasing operation at the initializing process.

The invention of claim 13 is the invention of claim 11, wherein the event is an inventory operation and guides the coins temporarily held in the temporarily holding mechanism to a coin tube for accommodating coins to be dispensed by the releasing operation at the inventory operation.

The invention of claim 14 is the invention of claim 11, wherein the coins temporarily held in the temporarily holding mechanism are released one by one by the releasing operation.

The invention of claim 15 is the invention of claim 11, wherein the releasing operation is performed regardless of the presence or absence of the held coins.

The invention of claim 16 is a coin handling device which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, comprising:

determining means for previously determining the denominations and number of coins to be temporarily held in the temporarily holding mechanism;

counting means for counting the number of coins temporarily held in the temporarily holding mechanism; and control means which, when the count value by the counting means reaches the number determined by the determining means, returns the coins of the predetermined denomination inserted thereafter without temporarily holding in the temporarily holding mechanism.

The invention of claim 17 is the invention of claim 16, wherein the determining means can arbitrarily determine the number of coins to be held in the temporarily holding mechanism within a range of the temporarily holdable number of coins in the temporarily holding mechanism.

The invention of claim 18 is the invention of claim 16, wherein:

when at least one of the coins temporarily held in the temporarily holding mechanism is accommodated, the counting means subtracts the number of accommodated coins; and the control means temporarily holds newly inserted coins of the pertinent denomination in the temporarily holding mechanism until the count value by the counting means reaches the number determined by the determining means.

The invention of claim 19 is the invention of claim 16, wherein the control means comprises:

first control means for guiding the coins temporarily held in the temporarily holding mechanism to a coin return passage;

second control means for guiding the coins temporarily held in the temporarily holding mechanism to a coin tube; and third control means for guiding the coins temporarily held in the temporarily holding mechanism to a coin box; wherein:

when the count value by the counting means reaches the number of coins determined by the determining means and the return instruction is issued, the first control means is operated to guide the coins temporarily held in the temporarily holding mechanism to the coin return passage, and when the accommodation instruction is issued, the second control means or the third control means is operated to guide the coins temporarily held in the temporarily holding mechanism to the coin tube or the coin box.

The invention of claim 20 is the invention of claim 19, wherein:

the first control means includes:

first sorting means which is disposed downstream of the temporarily holding mechanism and sorts the coins temporarily held in the temporarily holding mechanism to guide to the coin return passage or to the second control means and the third control means, and a first solenoid for operating the first sorting means; and the second control means and the third control means include:

second sorting means which is disposed between the first sorting means and the coin tube and guides the coins having passed through the first sorting means to the coin box or the coin tube, and a second solenoid for operating the second sorting means.

The invention of claim 21 is A coin handling device which identifies authentic or counterfeit and denomination of inserted coins, has a temporarily holding mechanism for temporarily holding coins of at least one denomination, accommodates a necessary number of coins from the coins temporarily held in the temporarily holding mechanism according to an accommodation instruction, and returns the coins temporarily held in the temporarily holding mechanism according to a return instruction, comprising:

coin releasing means for releasing the coins temporarily held in the temporarily holding mechanism upon receiving the accommodation instruction; and coin sorting means for sorting the coins released from the coin releasing means to accommodate into a coin box for recovering coins or a coin tube for accommodating coins to be dispensed.

The invention of claim 22 is the invention of claim 21, wherein the coin sorting means sorts the coins released by the coin releasing means to the coin tube if the number of coins accommodated in the coin tube is less than a permissible number and sorts the coins released by the coin releasing means to the coin box if the number of coins accommodated in the coin tube is not less than the permissible number.

The invention of claim 23 is the invention of claim 21, wherein the coin sorting means sorts the coins released by the coin releasing means to the coin tube if the number of coins accommodated in the coin tube is less than a predetermined number and sorts the coins released by the coin releasing means to the coin box if the number of coins accommodated in the coin tube is not less than the predetermined number.

The invention of claim 24 is the invention of claim 22, wherein:

the coins have a plurality of types in the same denomination; and the coin sorting means sorts the coins to the coin box regardless of the number of coins accommodated in the coin tube if the coins temporarily held in the temporarily holding mechanism are those of predetermined types.

The invention of claim 25 is the invention of claim 21, wherein the coin releasing means releases the coins temporarily held in the temporarily holding mechanism one by one.

The invention of claim 26 is the invention of claim 21, wherein the coin sorting means accommodates the coins related to the accommodation instruction into the coin tube or the coin box and returns the other coins if the accommodation instruction is issued about some of the coins temporarily held in the temporarily holding mechanism.

The invention of claim 27 is the invention of claim 26, wherein:

the coins have a plurality of types in the same denomination; and the coin sorting means accommodates the coins of a previously designated type into the coin tube or the coin box with a high priority among the coins of the plurality of types.

The invention of claim 28 is a coin handling device which identifies authentic or counterfeit and denomination of inserted coins, has a temporarily holding mechanism for temporarily holding coins of-at least one denomination, accommodates a necessary number of coins from the coins temporarily held in the temporarily holding mechanism according to an accommodation instruction, and returns the coins temporarily held in the temporarily holding mechanism according to a return instruction, comprising:

coin releasing means for releasing the coins temporarily held in the temporarily holding mechanism; and control means which, when a predetermined event takes place, makes the coin releasing means perform at least one operation of releasing the coins temporarily held in the temporarily holding mechanism.

The invention of claim 29 is the invention of claim 28, further comprising first coin guiding means for guiding the coins released by the coin releasing means to the coin box for recovering coins, wherein the control means detects the performance of an initializing operation including a power turning-on time as an occurrence of the predetermined event, and performs the releasing operation by the coin releasing means and guides the coins released by the releasing operation to the coin box by the first guiding means.

The invention of claim 30 is the invention of claim 28, further comprising second coin guiding means for guiding the coins released by the coin releasing means to a coin tube for accommodating coins to be dispensed, wherein:

the control means detects an inventory operation as an occurrence of the predetermined event, performs a releasing operation by the coin releasing means, and guides the coins released by the releasing operation to the coin tube by the second guiding means.

The invention of claim 31 is the invention of claim 28, wherein the control means releases the coins temporarily held in the temporarily holding mechanism one by one by the coin releasing means.

The invention of claim 32 is the invention of claim 28, wherein the control means makes the coin releasing means repeat the operation of releasing a maximum number of coins temporarily holdable in the temporarily holding mechanism regardless of the presence or absence of the coins temporarily held in the temporarily holding mechanism.

The invention of claim 33 is the invention of claim 28, wherein the control means makes the coin releasing means perform a predetermined number of releasing operations regardless of the presence or absence of the coins temporarily held in the temporarily holding mechanism.

According to the present invention, to return the inserted coins when any coins are to be returned, it is configured so that the temporary holding number for temporarily holding the inserted coins can be determined arbitrarily, and the coins inserted not less than the determined number are returned. Therefore, the coin holding number can be determined according to the price of a commodity vended by the automatic vending machine or the like, and counterfeit coins can be prevented from being used without impairing the convenience of using authentic coins.

It is also configured to guide the coins temporarily held in the escrow passage to any of the coin tube, the return passage and the coin box passage depending on the states of the respective portions, so that the number of coins in the coin tube can be determined arbitrarily, and only the coins to be collected can be collected.

Besides, it is configured to operate so to guide the coins in the escrow passage to the coin box at the time when the power is turned on, so that inconvenience to the users can be prevented without suffering from illegal acquirement of any coins possibly remained in the escrow passage and excluding such coins from being dispensed as change.

And, efficiency of the inventory work can be improved by guiding the coins in the escrow passage to the coin tube at the inventory operation.

BRIEF DESCRIPTION OF THE DRAWINGS

FIG. 10 is a flow chart showing a flow of operation of the coin handling device 100 when the power is turned on.

DESCRIPTION OF THE PREFERRED EMBODIMENTS

An embodiment of the coin handling method and device to which the invention pertains will be described in detail with reference to the accompanying drawings.

Figure 1:
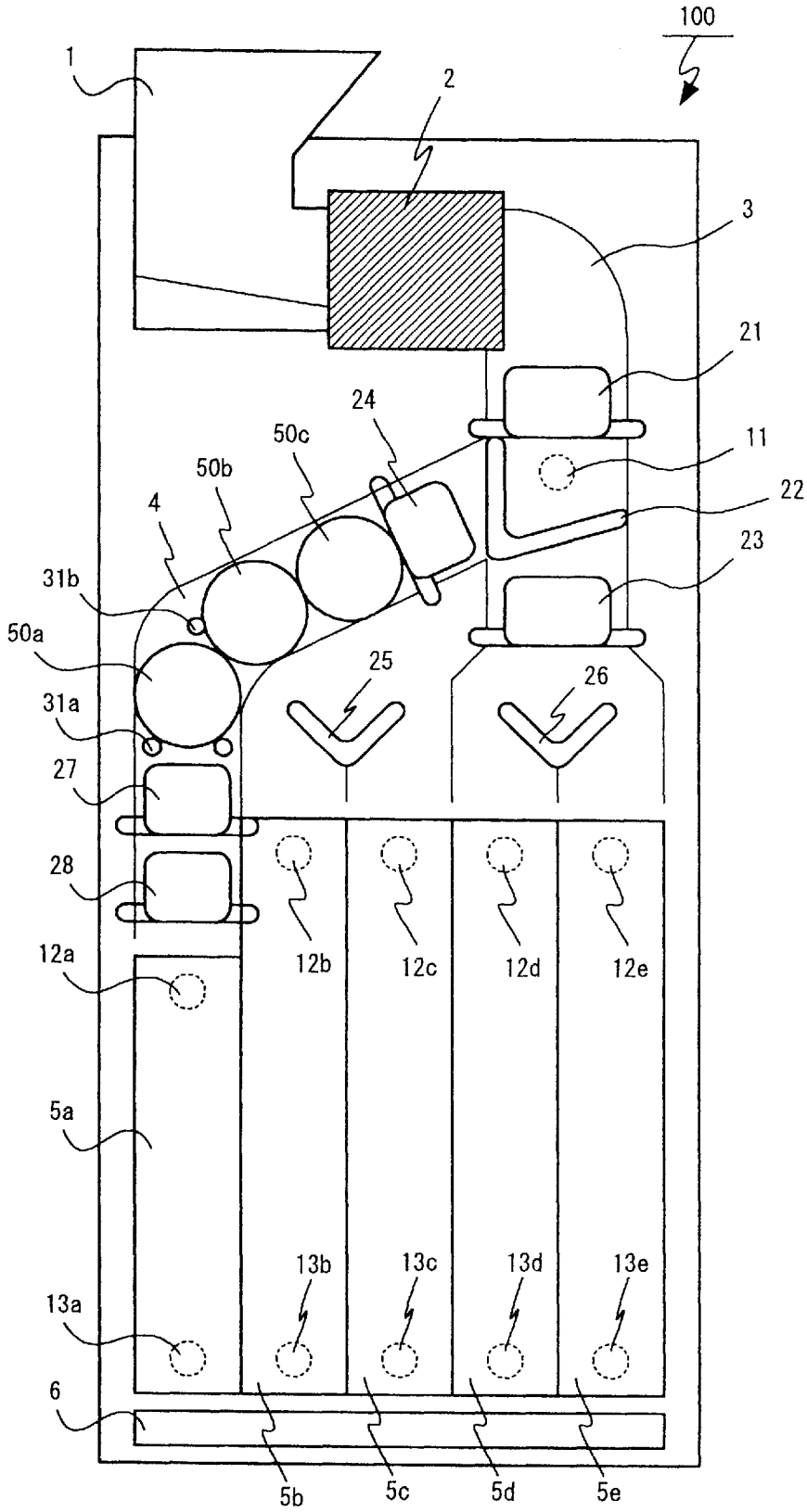
FIG. 1 is a diagram (1) illustrating a schematic structure of the coin handling device to which the invention pertains.
Figure 2:
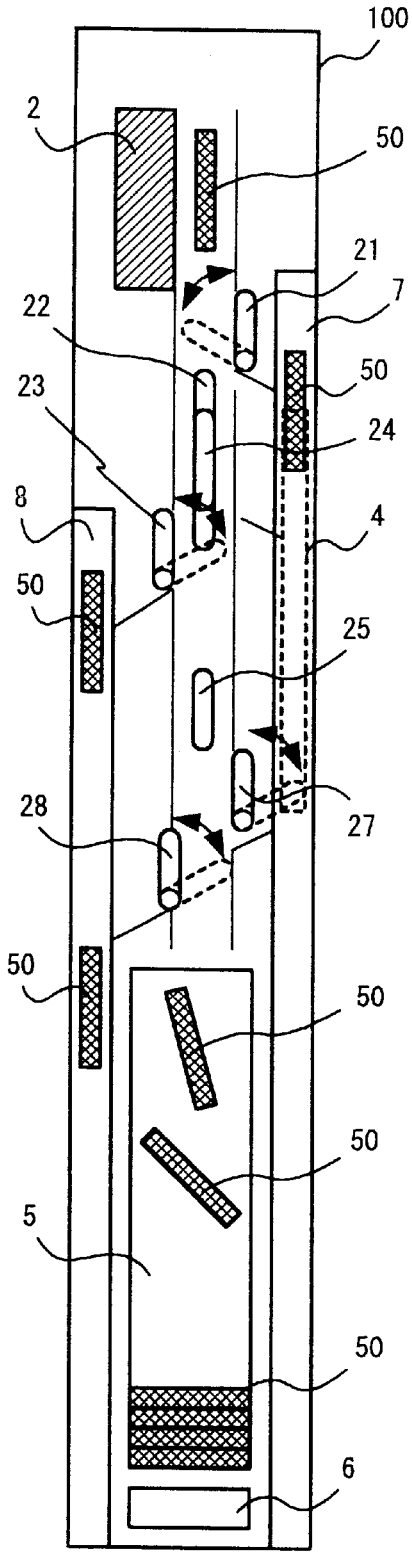
FIG. 2 is a diagram (2) illustrating a schematic structure of the coin handling device to which the invention pertains.
Figure 3:
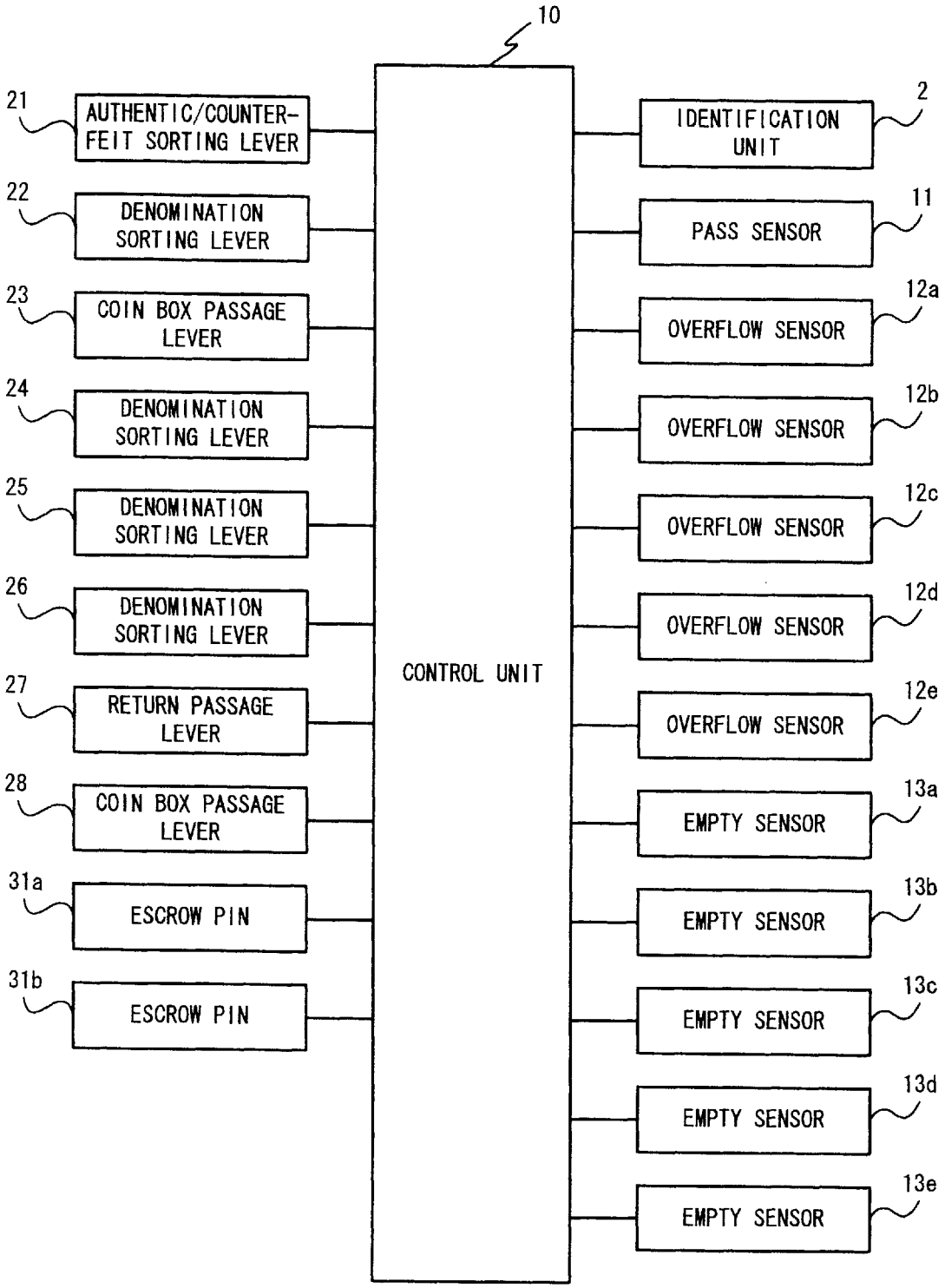
FIG. 3 is a block diagram showing a control structure of the coin handling device.

FIG. 1 and FIG. 2 are diagrams illustrating the schematic structures of the coin handling device to which the present invention pertains. FIG. 1 shows its front view and FIG. 2 shows a side view. FIG. 3 is a block diagram showing a schematic structure of the coin handling device.

The coin handling device 100 comprises insertion unit 1 as an inserted coin receptacle, identification unit 2 for identifying the inserted coins as authentic or counterfeit and denominations, coin passage 3 through which the coins roll or fall, escrow passage 4 for temporarily holding (escrowing) predetermined denomination coins, coin tubes 5 (5*a* to 5*e*) for storing the coins by denomination, dispense unit 6 for dispensing coins from the coin tubes 5, return passage 7 for guiding an inserted coin to an unshown return port, and coin box passage 8 for guiding an inserted coin to an unshown coin box.

The coin handling device 100 is provided with various types of sensors for detecting the states of coins. For example, such sensors include pass sensor 11 for detecting the passage of coins, overflow sensors 12 (12*a* to 12*e*) for detecting that the coin tubes 5 are filled with coins, and empty sensors 13 (13*a* to 13*e*) for detecting that the coin tubes 5 become empty of coins.

The coin handling device 100 is provided with authentic/counterfeit sorting lever 21 for guiding coins to a predetermined position, denomination sorting lever 22, coin box passage lever 23, denomination sorting levers 24, 25, 26, return passage lever 27, coin box passage lever 28, and escrow pins 31*a*, 31*b* for escrowing coins. Such portions are driven by an actuator such as a solenoid, and the actuator may be separately provided for each portion or a single actuator may operate a plurality of levers and the like.

A flow of coins in the coin handling device 100 will be described below.

Coins 50 inserted through the insertion unit 1 of the coin handling device 100 are identified as authentic or counterfeit and denominations by the identification unit 2. A coin judged as a counterfeit coin by the identification unit 2 is guided to the return passage 7 (see FIG. 2) at the front of the coin handling device 100 by the authentic/counterfeit sorting lever and returned through an unshown return port.

Meanwhile, coins identified as authentic by the identification unit 2 are guided to any of the coin tubes 5*a* to 5*e* by denomination, but if the relevant coin tube 5 (any of 5*b* to 5*e* excluding 5*a*) is full, the coins are guided to the coin box passage 8 (see FIG. 2) at the back of the coin handling device 100 by the operations of the denomination sorting lever 22 and the coin box passage lever 23 and then stored in an unshown coin box.

If the coin tubes are not fill and the inserted coin is of denomination to be guided to the coin tube 5*a*, the coin is guided by the operations of the denomination sorting lever 22 and the denomination sorting lever 24 to the escrow passage 4 at the front of the coin handling device 100 and temporarily held in the escrow passage 4 by the escrow pin 31*a*.

If the inserted coin is of denomination to be guided to the coin tube 5*b*, it is guided to the coin tube 5*b* by the denomination sorting lever 22, the denomination sorting lever 24 and the denomination sorting lever 25, and if it is of denomination to be guided to the coin tube 5*c*, it is guided to the coin tube 5*c* by the denomination sorting lever 22, the denomination sorting lever 24 and the denomination sorting lever 25. If the inserted coin is of denomination to be guided to the coin tube 5*d*, it is guided to the coin tube 5*d* by the denomination sorting lever 22, the coin box passage lever 23 and the denomination sorting lever 26, and if it is of denomination to be guided to the coin tube 5*e*, it is guided to the coin tube 5*e* by the denomination sorting lever 22, the coin box passage lever 23 and the denomination sorting lever 26.

The coins 50, for example the coins 50*a*, 50*b*, 50*c*, which are temporarily held in the escrow passage 4 are released to drop one by one as the escrow pins 31*a*, 31*b* alternately operate according to a collection instruction from an unshown automatic vending machine when a commodity article is bought. At that time, the coins are guided to the coin tube 5*a* by the operations of the return passage lever 27 and the coin box passage lever 28. But, if the coin tube 5*a* is fill, the coin box passage lever 28 operates reversely to guide the coins S0 to the coin box passage 8 at the back of the coin handling device 100 to store in the unshown coin box.

Where the coins 50 are temporarily held in the escrow passage 4 and a return instruction is given by the unshown automatic vending machine according to a refund operation or the like, the escrow pins 31*a*, 31*b* operate alternately to release the coins 50 one by one, so that the coins 50 are guided to the return passage 7 at the front of the coin handling device 100 by operating the refund passage lever 27 and returned through the unshown return port.

The above processes are realized as shown in the block diagram of FIG. 3 by the control unit 10 which operates the authentic/counterfeit sorting lever 21, the denomination sorting lever 22, the coin box passage lever 23, the denomination sorting levers 24, 25, 26, the return passage lever 27 and the coin box passage lever 28 and also the escrow pins 31*a*, 31*b* for escrowing the coins according to the detected results by the identification unit 2, the pass sensor 11, the overflow sensors 12*a* to 12*e* and the empty sensors 13*a* to 13*e*.

Then, the characteristic operations of the coin handling device 100 will be described below.

According to the characteristics of the coin handling device 100, the denomination and number of coins temporarily held in the escrow passage 4 can be determined as desired. Such determination is stored in a storage unit such as an unshown memory or the like and read by the control unit 10 so to be used to control the respective units. But, the denomination to be determined must be agreed with the denomination to be stored in the coin tube 5*a*, and the number of coins to be determined cannot exceed the maximum number of coins which can be stored in the escrow passage 4.

The denomination and number of coins to be held temporarily are determined according to for example the maximum vend price or availability of series vend by an automatic vending machine or the like in which the coin handling device 100 is disposed. It is because even when coins exceeding the price of a commodity article which can be bought by inserting coins at a time are held temporarily, the coins exceeding that price are returned as a result, and the temporary holding of excess coins is meaningless.

Figure 4:
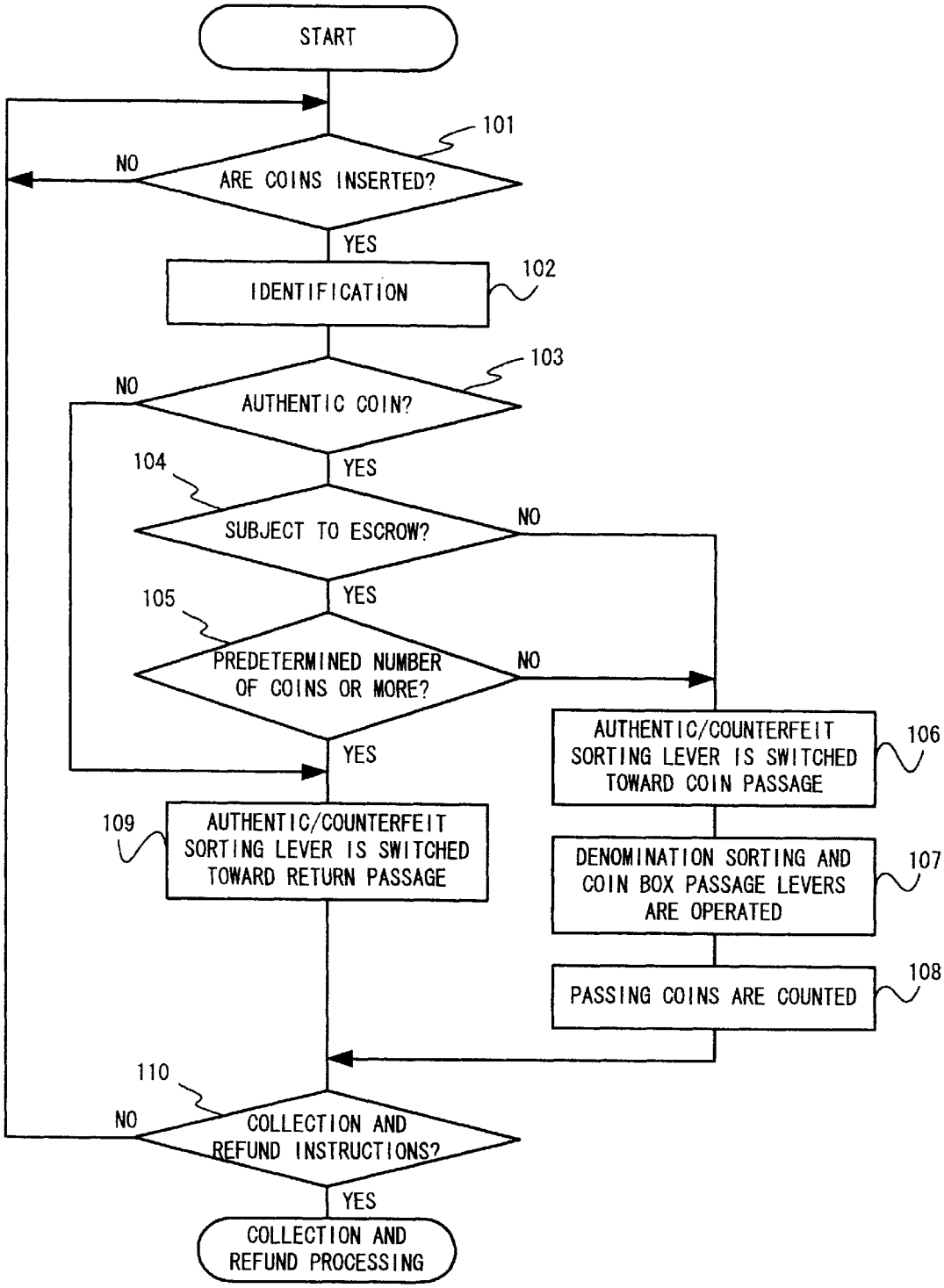
FIG. 4 is a flow chart showing a flow of operation of coin handling device 100.

Referring to FIG. 4, an operation of the coin handling device 100 will be described with the coins to be held temporarily in the escrow passage 4 determined to be two or more.

FIG. 4 is a flow chart showing a flow of operation of the coin handling device 100.

The coin handling device 100, when it is started, waits for the insertion of coins (NO in step 101).

When the coins are inserted (YES in step 101), the identification unit 2 identifies the coins (step 102), and when the inserted coins are identified as authentic coins (YES in step 103) and are denominations not subject to escrow (NO in step 104), the authentic/counterfeit sorting lever 21 is switched toward the coin passage 3 (step 106), and the denomination sorting levers 22, 24, 25, 26 are operated to guide the coins to the appropriate coin tube 5 (any of 5*b* to 5*e*) (step 107). Then, when the coins pass by the pass sensor 11 in the coin passage 3, they are detected by the pass sensor 11 and counted the number of inserted coins per denomination (step 108).

As a result of identification in the identification unit 2, when the inserted coins are of denomination subjected to the escrow (YES in step 104) and it is found as a result of counting the result detected by the pass sensor 11 that the coins temporarily held in the escrow passage 4 are less than the predetermined number of temporarily holding (NO in step 105), the authentic/counterfeit sorting lever 21 is switched toward the coin passage 3 (step 106), the denomination sorting levers 22, 24 are operated to guide the coins to the escrow passage 4 (step 107), and the coins are counted according to the results detected by the pass sensor 11 (step 108).

On the other hand, when the inserted coins are of denominations subject to the escrow (YES in step 104) and the coins temporarily held in the escrow passage 4 are not less than the predetermined number of temporarily holding (YES in step 105) or the inserted coins are counterfeit (NO in step 103), the authentic/counterfeit sorting lever 21 is switched toward the return passage 7 to return the counterfeit coins through the unshown return port (step 109).

The above processes are repeated until a money collection instruction or a refund instruction is given from the unshown automatic vending machine or the like (NO in step 110), and when the money collection or the refund instruction is given (YES in step 110), the money collection or refund processing is made, and the operation for a single vend is terminated. The money collection process will be described later in the specification.

The automatic vending machines or the like having the coin handling device 100 are mostly determined to accept coins when they are inserted even after selling a certain commodity in continuous vending. In such a case as above, the inserted amount and the sales price are settled after all the commodities are vended to dispense change. But, it can be designed to compare the inserted amount and the sales price for each sales of a single commodity, the temporarily held coins are collected into the coin tube 5*a*, and the insertion of other coins is accepted.

An operation of the above case will be described with reference to FIG. 5.

Figure 5:
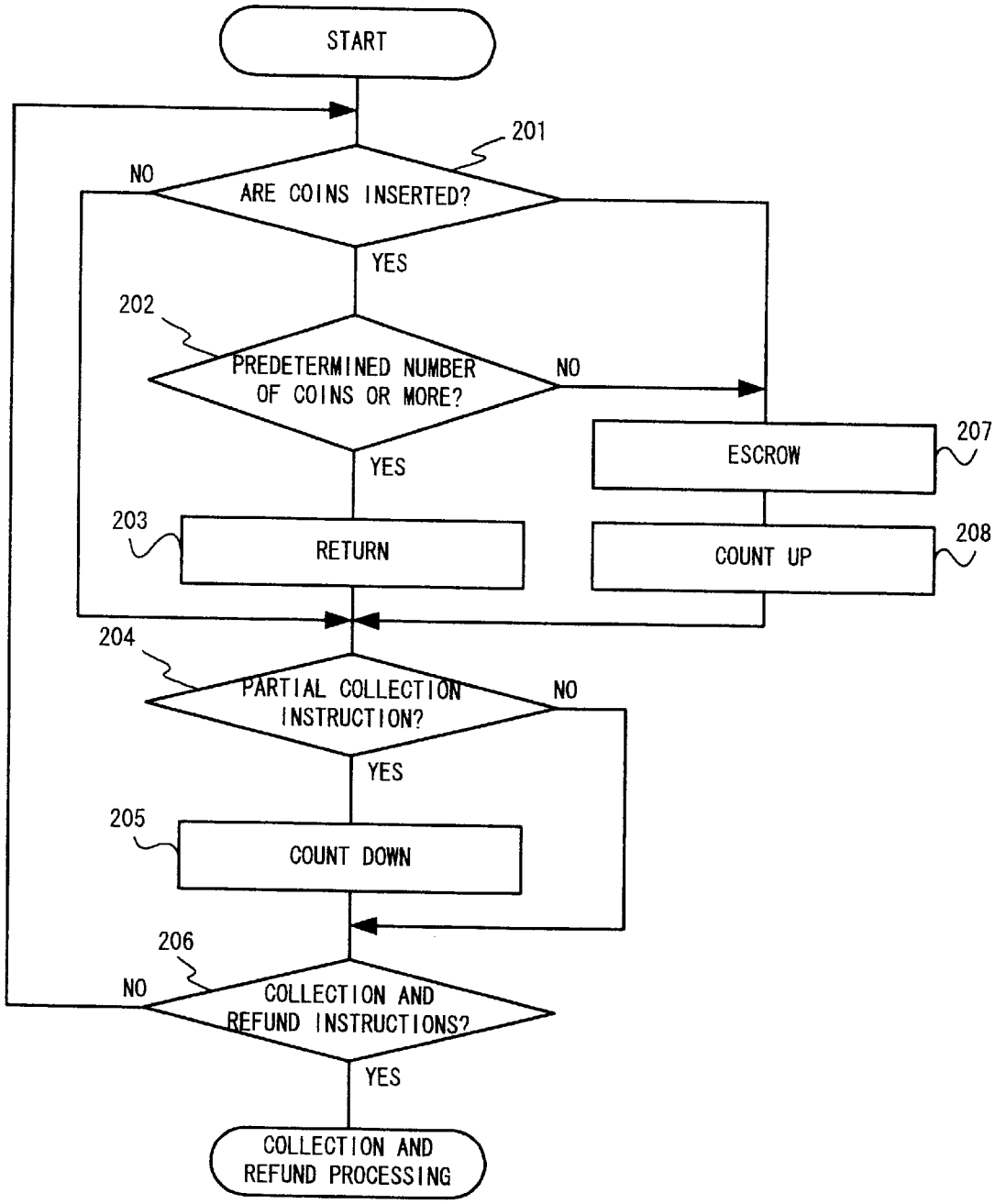
FIG. 5 is a flow chart showing a modified operation of the coin handling device 100.

FIG. 5 is a flow chart showing a modification of the operation of the coin handling device 100.

In the same way as described above, when coins are inserted (step 201) and the temporarily held number of denomination subject to the escrow is not less than the predetermined number of coins (YES in step 202), the coins are guided to the return passage 7 by the operation of the authentic/counterfeit sorting lever 21 and returned through the unshown return port (step 203). Then, when information about purchase of a commodity or the like is transmitted from the automatic vending machine and the control unit 10 judges that at least one of the coins temporarily held in the escrow passage 4 can be collected, it issues a money collection instruction (step 204) to operate the escrow pins 31*a*, 31*b* so to collect the coins into the coin tube 5*a*, and decreases the counted number of coins temporarily held in the escrow passage 4 (step 205).

Then, when the coins subjected to the escrow are inserted in a state without any money collection or refund instruction from the automatic vending machine (NO in step 206), because the number of coins temporarily held in the escrow passage 4 is less than the predetermined number (NO in step 202), the authentic/counterfeit sorting lever 21 is switched toward the coin passage 3 and the denomination sorting levers 22, 24 are moved to guide the coins into the escrow passage 4 (step 207), and the number of escrowed coins is counted up according to the result detected by the pass sensor 11 (step 208).

Now, the money collecting operation by the coin handling device 100 will be described below.

Figure 6:
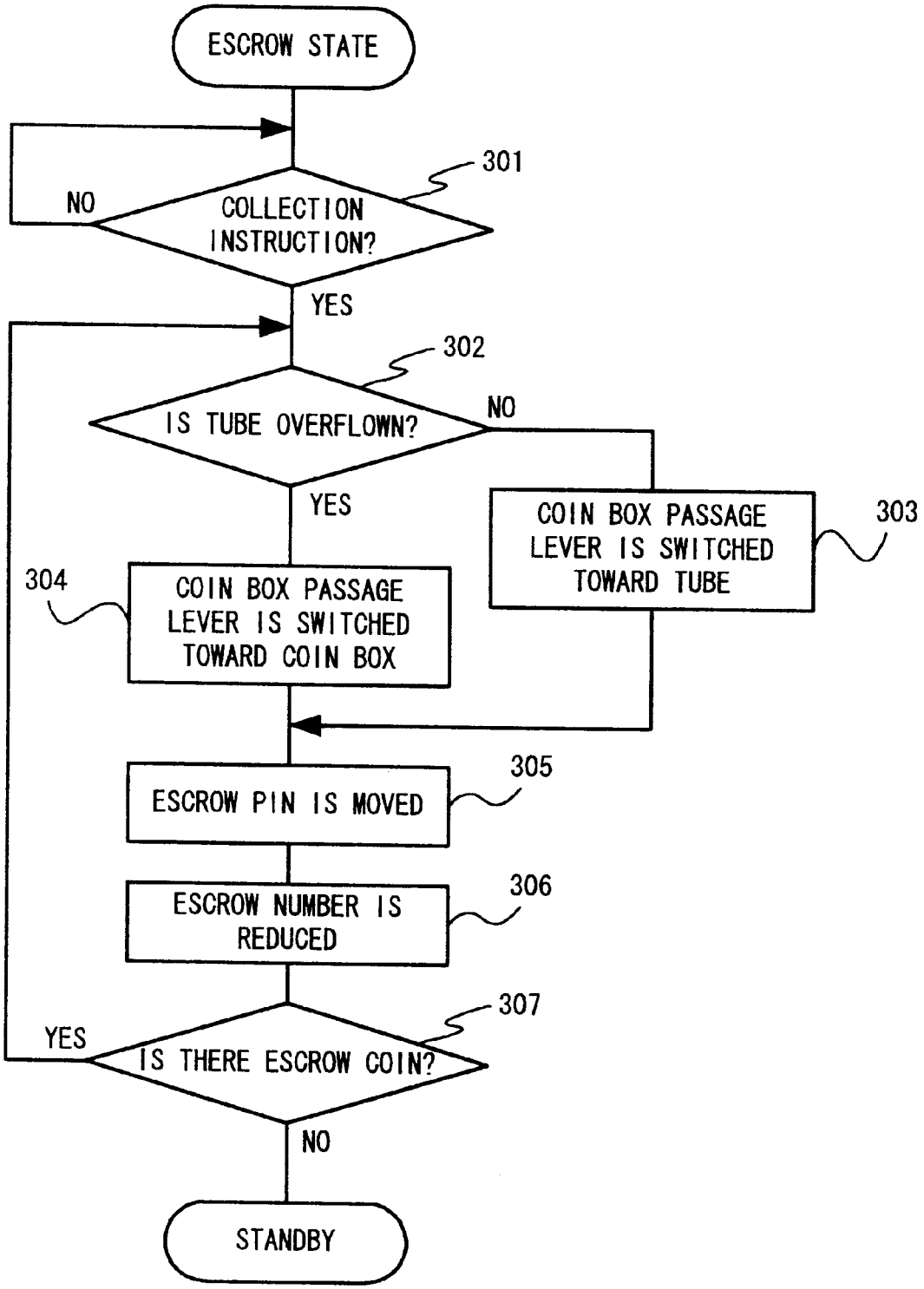
FIG. 6 is a flow chart showing a flow of operation of the coin handling device 100 to collect the temporarily held coins.

FIG. 6 is a flow chart showing a flow of operation of the coin handling device 100 at the collection of the temporarily held coins.

When the coin handling device 100 receives the money collection instruction in the escrow state of temporarily holding the coins in the escrow passage 4 (YES in step 301), if the coins in the coin tube 5*a* are not excessive (NO in step 302), the coin box passage lever 28 is switched toward the coin tube 5*a* (step 303), and if the coins in the coin tube 5*a* are excessive (YES in step 302), the coin box passage lever 28 is switched toward the coin box passage 8 (step 304).

The state that the coins in the coin tube 5*a* are excessive means that the overflow sensor 12*a* detects a state that the coins in the coin tube 5*a* have overflown or means that the coins stored in the coin tube 5*a* are in the limited number (the number of coins stored in the coin tube 5*a* is counted by an unshown counter) by the automatic change adjusting function or the like.

When the coin box passage lever 28 is switched, the escrow pins 31*a*, 31*b* are alternately operated to release one of the coins temporarily held in the escrow passage 4 (step 305). The released coin is guided to the coin tube 5*a* or the coin box passage 8 according to the state of the coin box passage lever 28.

When the escrow pins 31*a*, 31*b* are operated, the escrow number counted by the unshown counter is reduced (step 306), and if it is judged according to the counter that there are coins being escrowed (YES in step 307), the process returns to step 302, and the same process is repeated, and when the coins being escrowed are exhausted (NO in step 307), the process returns to a standby state.

The counter for counting the number of coins being escrowed counts the number of coins subject to the escrow when they pass through the coin passage 3 according to the output from the identification unit 2 and the pass sensor 11. But, it may be designed to repeat the processes of steps 302 and 305 for the maximum number of coins which can be held temporarily in the escrow passage 4 without using the counter.

Collection of all the coins in the escrow passage 4 was described with reference to FIG. 6, but all the coins are not necessarily accommodated. For example, where a commodity for the price of less than one escrow coin is purchased and a refund instruction is issued in a state that a plurality of escrow coins are temporarily held, only one coin is collected.

The operation to collect some of the temporarily held coins will be described with reference to FIG. 7.

Figure 7:
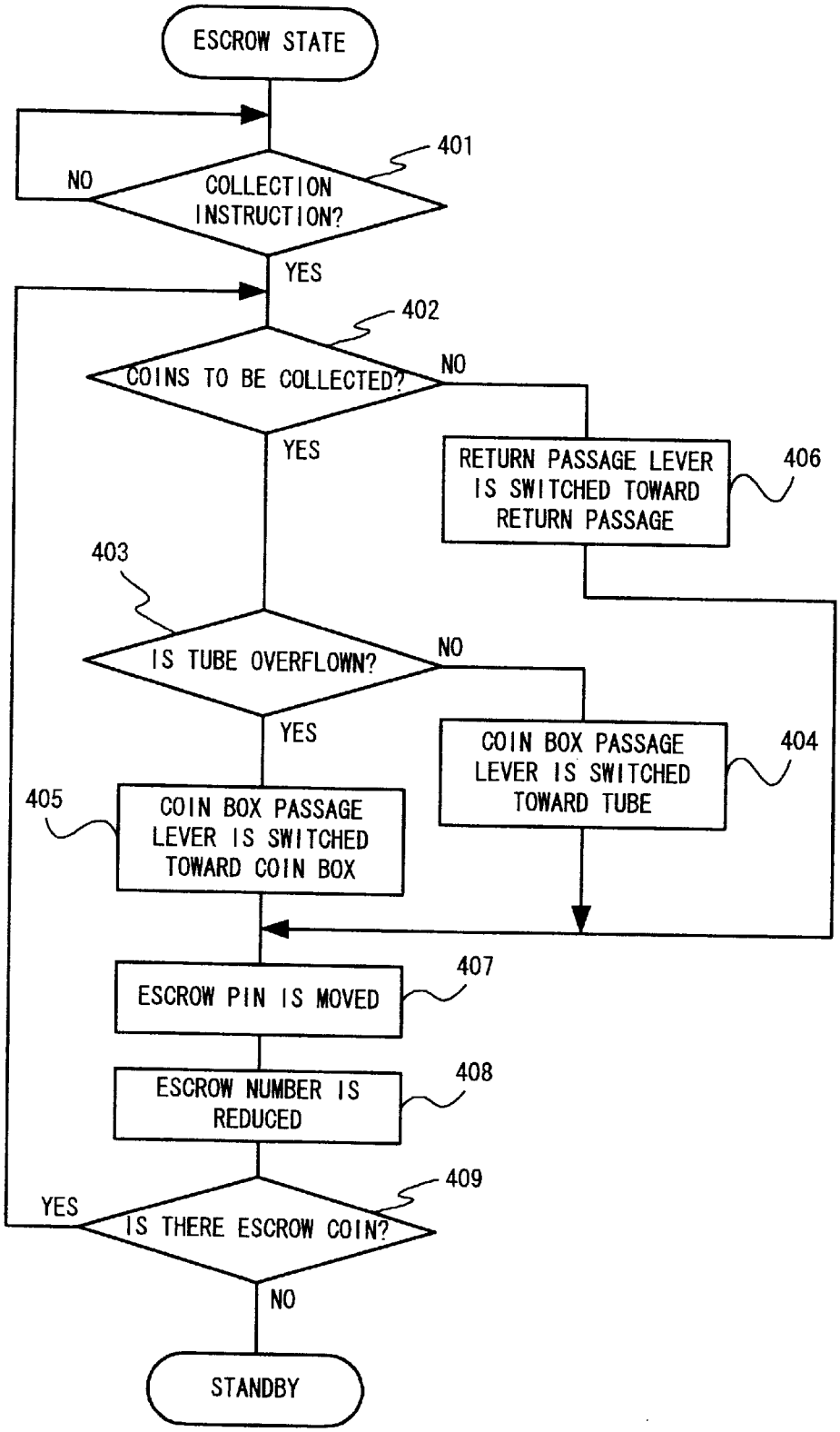
FIG. 7 is a flow chart showing a flow of operation of the coin handling device 100 to collect some of the temporarily held coins.

FIG. 7 is a flow chart showing a flow of operation of the coin handling device 100 when it collects some of the temporarily held coins.

Where a money collection instruction is issued in an escrow state that the coin handling device 100 temporarily holds the coins in the escrow passage 4 (YES in step 401), it is judged whether the first of the held coins is one to be collected or to be refund, and if it is a coin to be collected (YES in step 402) and the coins in the coin tube 5*a* are not in an excessive state (NO in step 403), the coin box passage lever 28 is switched toward the coin tube 5*a* (step 404).

If the coin is to be collected (YES in step 402) and the coins in the coin tube 5*a* are in an excessive state (YES in step 403), the coin box passage lever 28 is switched toward the coin box passage 8 (step 405).

If the coin is one to be refunded (NO in step 402), the return passage lever is switched toward the return passage 7 (step 406).

When the return passage lever 27 and the coin box passage lever 28 are switched, the escrow pins 31*a*, 31*b* are alternately operated to release only one of the coins temporarily held in the escrow passage 4 (step 407). The released coin is guided to any of the coin tube 5*a*, the return passage 7 and the coin box passage 8 according to the states of the return passage lever 27 and the coin box passage lever 28.

When the escrow pins 31*a*, 31*b* are operated, the escrow number being counted by the unshown counter is reduced (step 408), and if it is judged according to the counter that there are coins being escrowed (YES in step 409), the process returns to step 402, and the same process is repeated until the coins being escrowed are exhausted (NO in step 409) and returns to a standby state.

In the above description, the temporarily held coins in the escrow passage 4 were released one by one, but they can also be released at the same time. In such a case, the number of temporarily held coins is handled as a unit in order to judge whether the coins in the coin tube 5*a* are excessive or not.

Money including coins is sometimes changed to one having a different design and material for various reasons. When a coin is replaced by a new one, the old one does not become unusable at once but the new one and the old one coexist for a certain period. In such a period, a general coin handling device is designed so that it can handle both of the new and old coins at the same time. But, the coin handling device 100 of the invention can handle the new and old coins and can also be operated to recover the old coins positively (compulsory).

Figure 8:
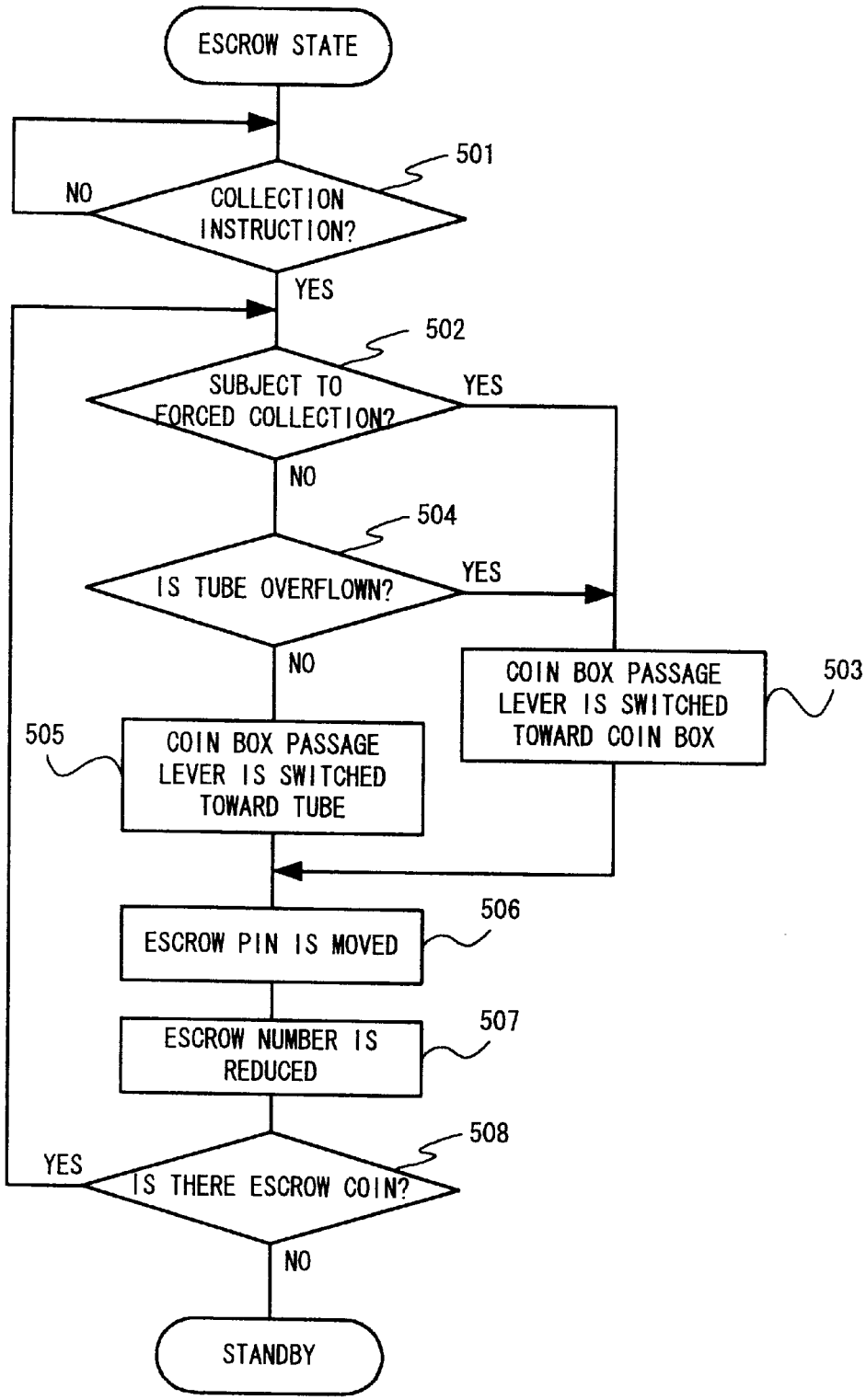
FIG. 8 is a flow chart showing a flow of operation of the coin handling device 100 to make the forced recovery of either new coins or old coins when the temporarily held coins are collected.

FIG. 8 is a flow chart showing a flow of operation of the coin handling device 100 to make compulsory recovery of either the new or old coin when the temporarily held coins are collected.

When the coin handling device 100 receives a collection instruction in an escrow state that coins are temporarily held in the escrow passage 4 (YES in step 501), it is judged whether the coin first released from the temporary holding is subjected to the forced collection (e.g., the old coin) (step 502). Such judgment is made by the control unit 10 which stores the judgment as well as the authentic and counterfeit and denominations made when the coins are passing the identification unit 2 before they are temporarily held in the escrow passage 4.

When the coin first released from the temporary holding is a coin subjected to the forced collection (YES in step 502), the coin box passage lever 28 is switched toward the coin box passage 8 (step 503).

On the other hand, when the coin first released from the temporary holding is not a coin subjected to the forced collection (NO in step 502), the coin accommodation state in the coin tube 5*a* is checked, and if the coins in the coin tube 5*a* are not excessive (NO in step 504), the coin box passage lever 28 is switched toward the coin tube 5*a* (step 505), and if the coins in the coin tube 5*a* are excessive (YES in step 504), the coin box passage lever 28 is switched toward the coin box passage 8 (step 503).

When the coin box passage lever 28 is switched, the escrow pins 31*a*, 31*b* are alternately operated to release only one of the coins temporarily held in the escrow passage 4 (step 506). The released coin is guided to the coin tube 5*a* or the coin box passage 8 according to the state of the coin box passage lever 28.

When the escrow pins 31*a*, 31*b* are operated, the escrow number being counted by the unshown counter is reduced (step 507), and if it is judged according to the counter that there is an escrowed coin (YES in step 508), the process returns to step 502 to repeat the same process, and if the escrowed coin is exhausted (NO in step 508), the process returns to a standby state.

Thus, when the coin subjected to the forced collection is in the escrowed state and is collected, it can be collected into the coin box 8 by forcedly switching the coin box passage lever 28 toward the coin box 8 regardless of the state of the coin tube 5*a*.

And, where the empty sensor 13*a* in the coin tube 5*a* detects that no coin is stored in the coin tube 5*a*, the forced recovery of coins is not performed because coins used for change are short, and the operation shown in FIG. 6 may be performed.

The coin to be positively recovered may be either a new or old coin, and such setting can be switched by changing the operation of the control unit 10 by an unshown switch or by rewriting an operation program of the control unit 10.

Where some of the temporarily held coins described with reference to FIG. 7 are collected, the coins subjected to the forced collection can be collected with a high priority. It is for example an operation to collect only the "old coin" when one coin is collected in the state that a "new coin", an "old coin" and a "new coin" are temporarily held in this order in the escrow passage 4.

An operation of collecting the coin subjected to the forced collection with a high priority will be described with reference to FIG. 9.

Figure 9:
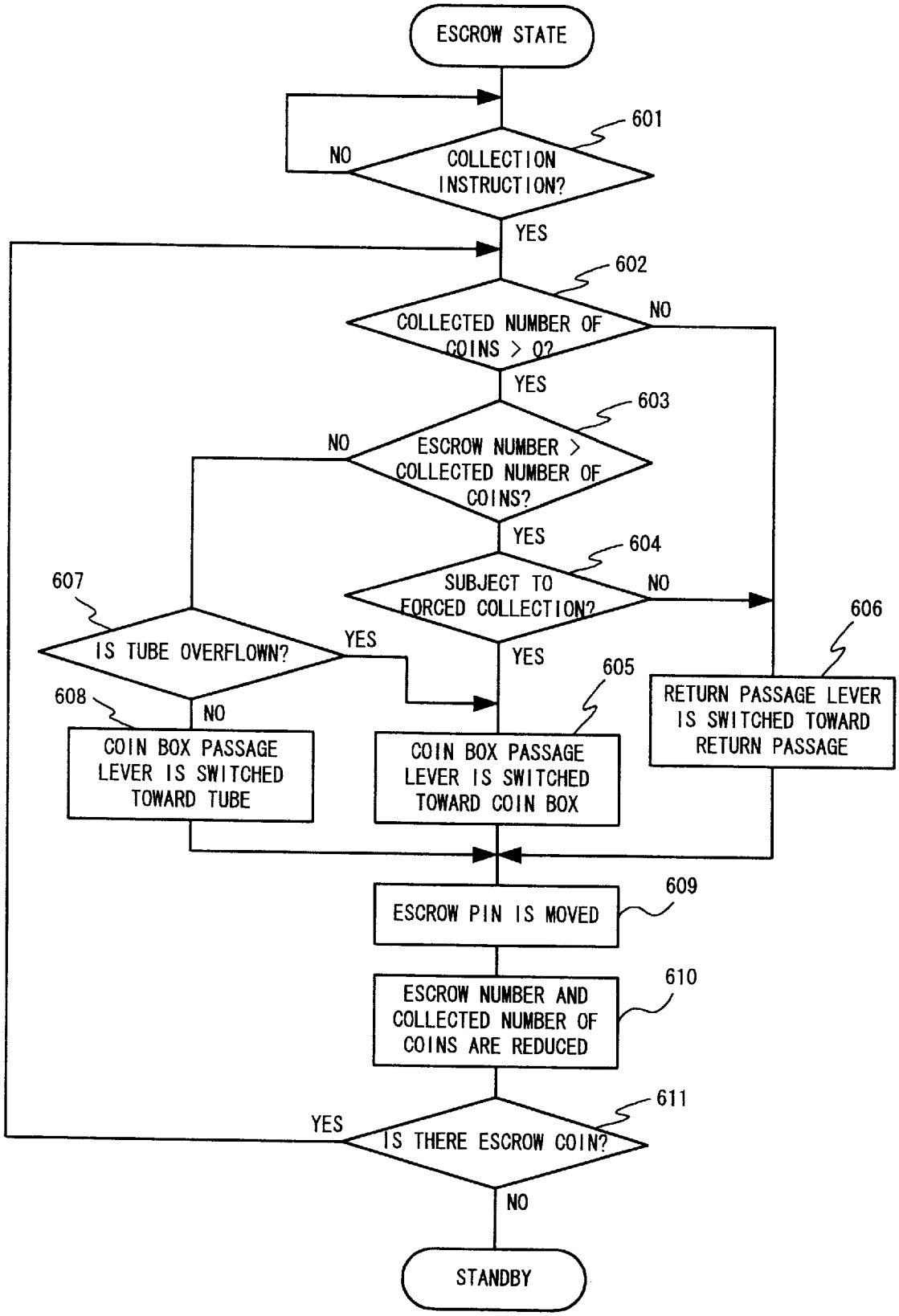
FIG. 9 is a flow chart showing a flow of operation of the coin handling device 100 to collect the coins subject to the forced collection with a high priority assigned.

FIG. 9 is a flow chart showing a flow of operation of the coin handling device 100 to collect the coin subjected to the forced collection with a high priority.

Where the coin handling device 100 receives a collection instruction when it is in the escrow state of temporarily holding coins in the escrow passage 4 (YES in step 601), it is judged whether there is any coin to be collected (step 602). If there is a coin to be collected, namely if the number of coins to be collected is larger than zero (YES in step 602), the escrow number indicating the number of coins temporarily held in the escrow passage 4 is compared with the number of collected coins (step 603).

If the escrow number is larger than the number of collected coins (YES in step 603), a coin to be released next from the temporary holding may be collected or returned, so that it is whether it is subjected to the forced collection (step 604), and if it is subjected to the forced collection (YES in step 604), the coin box passage lever 28 is switched toward the coin box 8 (step 605), but if it is not subjected to the forced collection (NO in step 604), the return passage lever 27 is switched toward the return passage 7 (step 606).

If the number of collected coins is equal to the escrow number (NO in step 603, the number of collected coins cannot be larger than the escrow number), the state of coins stored in the coin tube 5*a* is checked, and if the coins in the coin tube 5*a* are not excessive (NO in step 607), the coin box passage lever 28 is switched toward the coin tube 5*a* (step 608), and if the coins in the coin tube 5*a* are excessive (YES in step 607), the coin box passage lever 28 is switched toward the coin box passage 8 (step 605).

When the return passage lever 27 and the coin box passage lever 28 are switched, the escrow pins 31*a*, 31*b* are alternately operated to release only one of the coins temporarily held in the escrow passage 4 is released (step 609). The released coin is guided to any of the coin tube 5*a*, the return passage 7 and the coin box passage 8 depending on the states of the return passage lever 27 and the coin box passage lever 28.

When the escrow pins 31*a*, 31*b* are operated, the escrow number being counted by the unshown counter is reduced, and when the coins are collected, the number of collected coins is reduced (step 610), and when it is judged according to the counter that there are coins being escrowed (YES in step 611), the process returns to step 602 to repeat the same process, and when the coins being escrowed are exhausted (NO in step 611), the process returns to the standby state. When the number of collected coins becomes zero through the above repeated process (NO in step 602), the temporarily held coins remained are to be returned, so that the return passage lever 27 is switched toward the return passage 7 (step 606).

The operation shown in FIG. 9 is an example, and it may be designed so that the control unit 10 determines in advance to guide the respective coins to which of the coin tube 5*a*, the return passage 7 and the coin box passage 8 according to the types (whether they are subjected to the forced collection) and number of coins temporarily held in the escrow passage 4 and the number of coins to be collected, and the return passage lever 27, the coin box passage lever 28 and the escrow pins 31*a*, 31*b* are operated according to the above determination.

A case that the power of the coin handling device 100 is cut off due to a power failure or the like will be described.

When the power of the coin handling device 100 is cut off, the authentic/counterfeit sorting lever 21 is fixed in a direction to guide the inserted coins to the return passage 7. Therefore, even when a coin is inserted during the power off, there is not any problem because the coin is returned from the unshown return port through the return passage 7.

But, the escrow pins 31*a*, 31*b* are alternately operated, and if the power is cut off while the coins are temporarily held in the escrow passage 4, at least one of the escrow pins 31*a*, 31*b* is fixed with the coins temporarily held, so that the coins are remained in the escrow passage 4.

Therefore, the coin handling device 100 cannot be expected to operate normally unless the coins possibly remained in the escrow passage 4 at the power turning-on time are moved somewhere.

Accordingly, the processing of moving the coins possibly remained in the escrow passage 4 is performed, and their destinations from the escrow passage 4 include the unshown return port through the coin tube 5*a* and the return passage 7 and the unshown coin box through the coin box passage 8 by the operations of the return passage lever 27 and the coin box passage lever 28.

But, guiding of the remained coins to the return port can not be realized because the coins might be illegally acquired. And, guiding to the coin tube 5*a* is also difficult to realize because the coins are not necessarily authentic.

Therefore, the coins possibly remained in the escrow passage 4 are determined to be guided to the unshown coin box when the power is turned on.

The operation of the coin handling device 100 when the power is turned on will be described with reference to FIG. 10.

Figure 10:
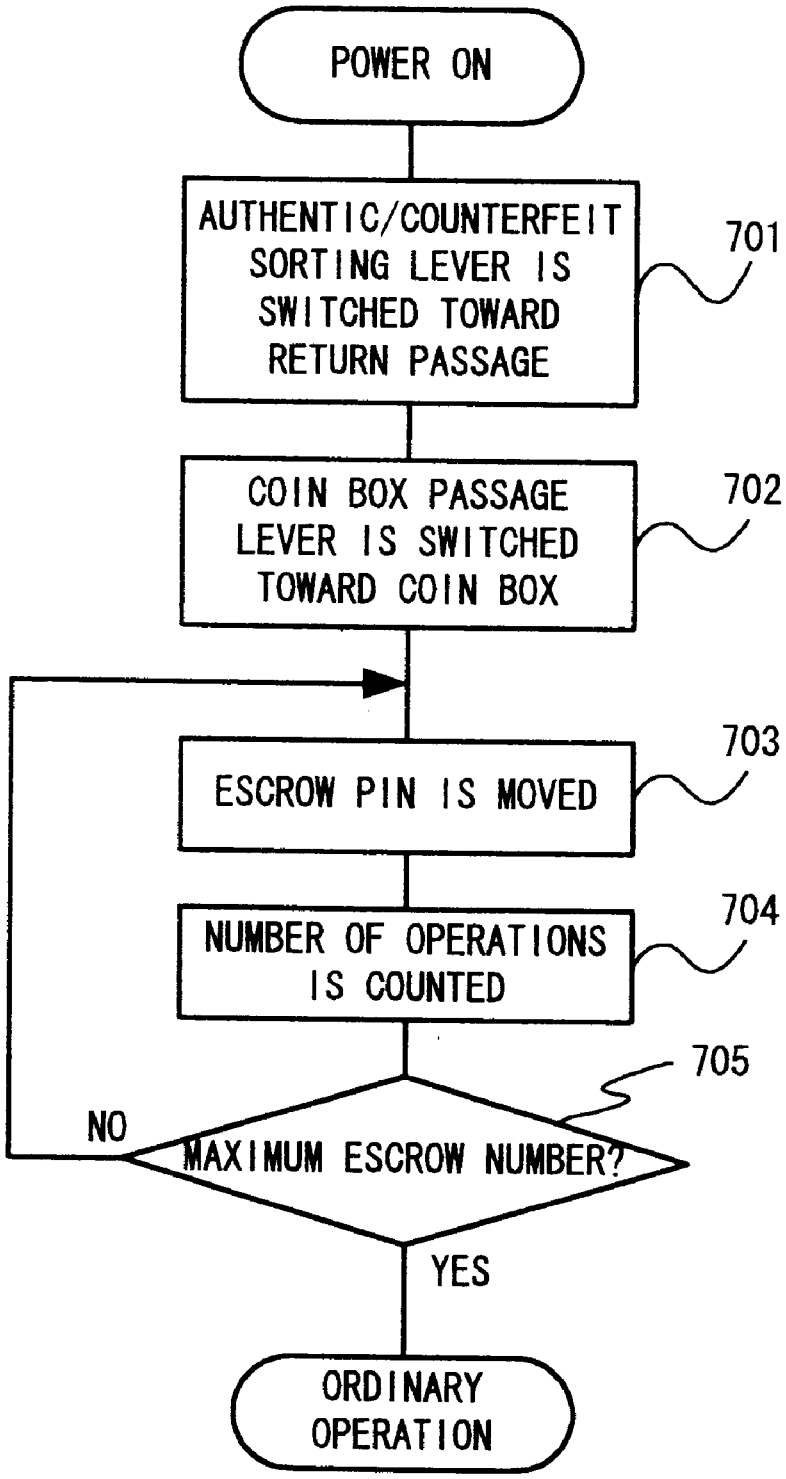

FIG. 10 is a flow chart showing a flow of operation of the coin handling device 100 when it is turned on.

When the coin handling device 100 is turned on, the authentic/counterfeit sorting lever 21 is switched toward the return passage 7 to guide a newly inserted coin to the return port (step 701). But, the authentic/counterfeit sorting lever 21 is stopped at the position to guide the inserted coin to the return passage 7 when the power is cut off, so that the above operation is a confirmation operation.

Then, the coin box passage lever 28 is switched toward the coin box passage 8 (step 702), the escrow pins 31*a*, 31*b* are operated to release only one of the coins (if there are) in the escrow passage 4 (step 703), and the number of operations is counted (step 704).

The operation of releasing the coins from the escrow passage 4 is repeated for the maximum number of coins (including the determined maximum number of coins) temporarily held in the escrow passage 4 (NO in step 705), and when the repeated operation is terminated (YES in step 705), the coin handling device 100 returns to the ordinary operation.

As described above, when the coin handling device 100 is turned on, the coins possibly remained in the escrow passage 4 are guided to the unshown coin box. There is a possibility that a coin is remaining in the escrow passage for some reasons when an inventory operation is performed. In such a case, even when the remained coin is for example a counterfeit coin, the operator can visually recognize it, so that it is desirable that the remained coin is guided not to the coin box but to the coin tube 5*a*, and then the dispensing operation is performed.

Accordingly, the coin handling device 100 guides the remaining coin to the coin tube 5*a* at the inventory operation.

The operation of the coin handling device 100 at the inventory operation will be described with reference to FIG. 11.

Figure 11:
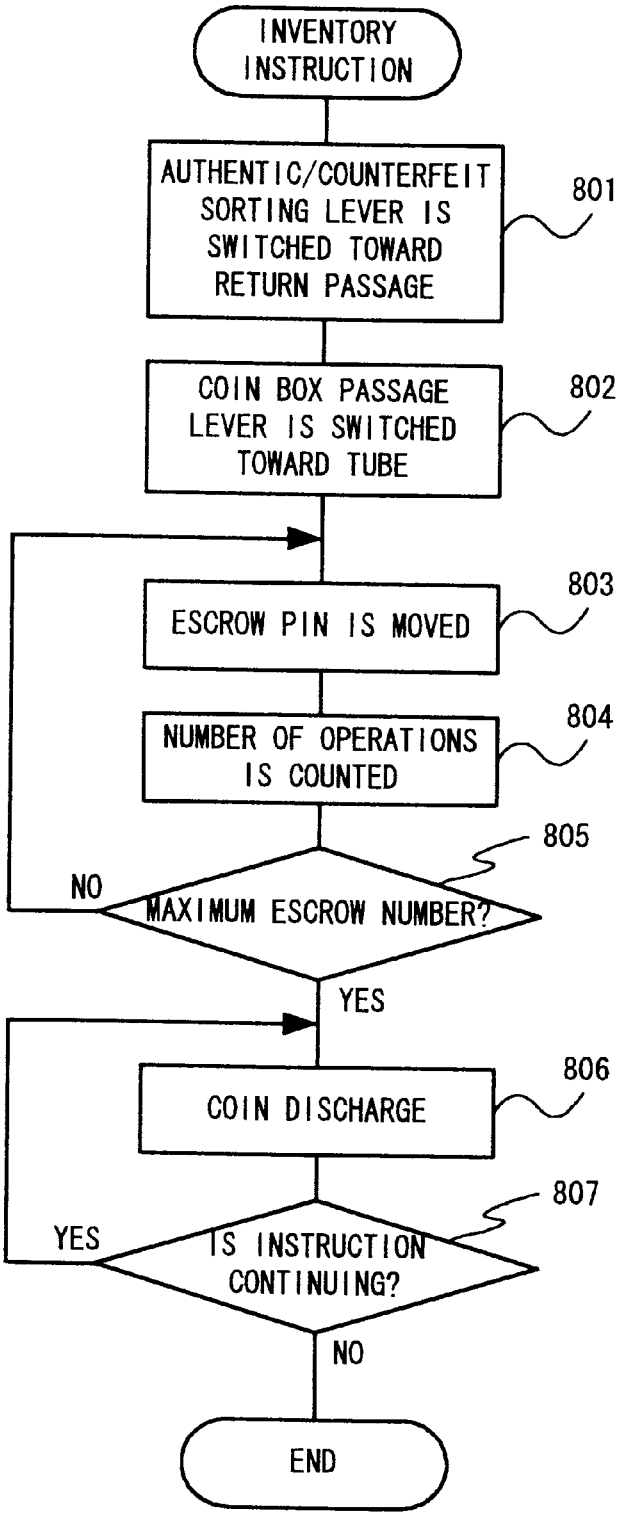
FIG. 11 is a flow chart showing a flow of operation of the coin handling device 100 at the inventory operation.

FIG. 11 is a flow chart showing a flow of operation of the coin handling device 100 at the inventory operation.

Upon receipt of an inventory instruction, the coin handling device 100 switches the authentic/counterfeit sorting lever 21 toward the return passage 7 so to guide newly inserted coins to the return port (step 801).

Then, the coin box passage lever 28 is switched toward the coin box passage 8 (step 802), the escrow pins 31*a*, 31*b* are operated to release only one of the coins (if they are) in the escrow passage 4 (step 803), and the number of operations is counted (step 804).

The operation to release the coins from the escrow passage 4 is repeated for the maximum number of coins which can be temporarily held in the escrow passage 4 (NO in step 805). After the repeated operation is terminated (YES in step 805), the coin handling device 100 discharges the coins from the coin tubes 5 (5*a* to 5*e*) (step 806), repeats the operation during the inventory instruction is continuous (YES in step 807), and when the inventory instruction is stopped (NO in step 807), terminates the inventory operation.

What is claimed is:

1. A coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein:

the denominations and number of coins to be temporarily held in the temporarily holding mechanism are previously determined; and when coins of the predetermined denominations are inserted in the predetermined number, the inserted coins are returned without being temporarily held in the temporarily holding mechanism.

2. The coin handling method according to claim 1, wherein the number of coins temporarily held is determined arbitrarily within a range of the temporarily holdable number of coins in the temporarily holding mechanism.

3. The coin handling method according to claim 2, wherein if at least one of the coins temporarily held in the temporarily holding mechanism is accommodated, coins of the pertinent denomination newly inserted within the range of the predetermined number of coins can be temporarily held in the temporarily holding mechanism.

4. A coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein:

when the accommodation instruction is given, the held coins are selectively sorted and accommodated into a coin box for recovering coins or a coin tube for accommodating coins to be dispensed.

5. The coin handling method according to claim 4, wherein the coins temporarily held in the temporarily holding mechanism are sorted to the coin tube if the number of coins accommodated in the coin tube is less than an allowable number and sorted to the coin box if the number of coins accommodated in the coin tube is not less than the allowable number.

6. The coin handling method according to claim 5, wherein the coins temporarily held in the temporarily holding mechanism are sorted to the coin tube if the number of coins accommodated in the coin tube is less than a predetermined number and sorted to the coin box if the number of coins accommodated in the coin tube is not less than the predetermined number.

7. The coin handling method according to claim 5, wherein:

the coins have a plurality of types in the same denomination; and if the coins temporarily held in the temporarily holding mechanism are those of predetermined types, they are sorted to the coin box regardless of the number of coins accommodated in the coin tube.

8. The coin handling method according to claim 4, wherein the coins temporarily held in the temporarily holding mechanism are released and sorted one by one from the held state.

9. The coin handling method according to claim 4, wherein when the accommodation instruction is issued about some of the coins temporarily held in the temporarily holding mechanism, the coins related to the accommodation instruction are accommodated and the other coins are returned.

10. The coin handling method according to claim 9, wherein:

the coins have a plurality of types in the same denomination; and coins of predetermined types are accommodated with a high priority among the coins of the plurality of types.

11. A coin handling method which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, wherein if a predetermined event takes place, an operation of releasing the coins temporarily held in the temporarily holding mechanism is performed at least one time.

12. The coin handling method according to claim 11, wherein:

the event is an initializing process including a power turning-on time, and the coins temporarily held in the temporarily holding mechanism are guided to a coin box for recovering coins by the releasing operation at the initializing process.

13. The coin handling method according to claim 11, wherein the event is an inventory operation and guides the coins temporarily held in the temporarily holding mechanism to a coin tube for accommodating coins to be dispensed by the releasing operation at the inventory operation.

14. The coin handling method according to claim 11, wherein the coins temporarily held in the temporarily holding mechanism are released one by one by the releasing operation.

15. The coin handling method according to claim 11, wherein the releasing operation is performed regardless of the presence or absence of the held coins.

16. A coin handling device which identifies authentic or counterfeit and denomination of inserted coins, has a temporarily holding mechanism for temporarily holding the identified coins of at least one denomination, accommodates a necessary number of coins from the coins temporarily held in the temporarily holding mechanism according to an accommodation instruction, and returns the coins temporarily held in the temporarily holding mechanism according to a return instruction, comprising:

determining means for previously determining the denominations and number of coins to be temporarily held in the temporarily holding mechanism;

counting means for counting the number of coins temporarily held in the temporarily holding mechanism; and control means which, when the count value by the counting means reaches the number determined by the determining means, returns the coins of the predetermined denomination inserted thereafter without temporarily holding in the temporarily holding mechanism.

17. The coin handling device according to claim 16, wherein the determining means can arbitrarily determine the number of coins to be held in the temporarily holding mechanism within a range of the temporarily holdable number of coins in the temporarily holding mechanism.

18. The coin handling device according to claim 16, wherein:

when at least one of the coins temporarily held in the temporarily holding mechanism is accommodated, the counting means subtracts the number of accommodated coins; and the control means temporarily holds newly inserted coins of the pertinent denomination in the temporarily holding mechanism until the count value by the counting means reaches the number determined by the determining means.

19. The coin handling device according to claim 16, wherein the control means comprises:

first control means for guiding the coins temporarily held in the temporarily holding mechanism to a coin return passage;

second control means for guiding the coins temporarily held in the temporarily holding mechanism to a coin tube; and third control means for guiding the coins temporarily held in the temporarily holding mechanism to a coin box; wherein:

when the count value by the counting means reaches the number of coins determined by the determining means and the return instruction is issued, the first control means is operated to guide the coins temporarily held in the temporarily holding mechanism to the coin return passage, and when the accommodation instruction is issued, the second control means or the third control means is operated to guide the coins temporarily held in the temporarily holding mechanism to the coin tube or the coin box.

20. The coin handling device according to claim 19, wherein:

the first control means includes:

first sorting means which is disposed downstream of the temporarily holding mechanism and sorts the coins temporarily held in the temporarily holding mechanism to guide to the coin return passage or to the second control means and the third control means, and a first solenoid for operating the first sorting means; and the second control means and the third control means include:

second sorting means which is disposed between the first sorting means and the coin tube and guides the coins having passed through the first sorting means to the coin box or the coin tube, and a second solenoid for operating the second sorting means.

21. A coin handling device which identifies authentic or counterfeit and denomination of inserted coins, has a temporarily holding mechanism for temporarily holding coins of at least one denomination, accommodates a necessary number of coins from the coins temporarily held in the temporarily holding mechanism according to an accommodation instruction, and returns the coins temporarily held in the temporarily holding mechanism according to a return instruction, comprising:

coin releasing means for releasing the coins temporarily held in the temporarily holding mechanism upon receiving the accommodation instruction; and coin sorting means for sorting the coins released from the coin releasing means to accommodate into a coin box for recovering coins or a coin tube for accommodating coins to be dispensed.

22. The coin handling device according to claim 21, wherein the coin sorting means sorts the coins released by the coin releasing means to the coin tube if the number of coins accommodated in the coin tube is less than a permissible number and sorts the coins released by the coin releasing means to the coin box if the number of coins accommodated in the coin tube is not less than the permissible number.

23. The coin handling device according to claim 21, wherein the coin sorting means sorts the coins released by the coin releasing means to the coin tube if the number of coins accommodated in the coin tube is less than a predetermined number and sorts the coins released by the coin releasing means to the coin box if the number of coins accommodated in the coin tube is not less than the predetermined number.

24. The coin handling device according to claim 22, wherein:

the coins have a plurality of types in the same denomination; and the coin sorting means sorts the coins to the coin box regardless of the number of coins accommodated in the coin tube if the coins temporarily held in the temporarily holding mechanism are those of predetermined types.

25. The coin handling device according to claim 21, wherein the coin releasing means releases the coins temporarily held in the temporarily holding mechanism one by one.

26. The coin handling device according to claim 21, wherein the coin sorting means accommodates the coins related to the accommodation instruction into the coin tube or the coin box and returns the other coins if the accommodation instruction is issued about some of the coins temporarily held in the temporarily holding mechanism.

27. The coin handling device according to claim 26, wherein:

the coins have a plurality of types in the same denomination; and the coin sorting means accommodates the coins of a previously designated type into the coin tube or the coin box with a high priority among the coins of the plurality of types.

28. A coin handling device which identifies authentic or counterfeit and denomination of inserted coins, has a temporarily holding mechanism for temporarily holding coins of at least one denomination, accommodates a necessary number of coins from the coins temporarily held in the temporarily holding mechanism according to an accommodation instruction, and returns the coins temporarily held in the temporarily holding mechanism according to a return instruction, comprising:

coin releasing means for releasing the coins temporarily held in the temporarily holding mechanism; and control means which, when a predetermined event takes place, makes the coin releasing means perform at least one operation of releasing the coins temporarily held in the temporarily holding mechanism.

29. The coin handling device according to claim 28, further comprising first coin guiding means for guiding the coins released by the coin releasing means to the coin box for recovering coins, wherein the control means detects the performance of an initializing operation including a power turning-on time as an occurrence of the predetermined event, and performs the releasing operation by the coin releasing means and guides the coins released by the releasing operation to the coin box by the first guiding means.

30. The coin handling device according to claim 28, further comprising second coin guiding means for guiding the coins released by the coin releasing means to a coin tube for accommodating coins to be dispensed, wherein:

the control means detects an inventory operation as an occurrence of the predetermined event, performs a releasing operation by the coin releasing means, and guides the coins released by the releasing operation to the coin tube by the second guiding means.

31. The coin handling device according to claim 28, wherein the control means releases the coins temporarily held in the temporarily holding mechanism one by one by the coin releasing means.

32. The coin handling device according to claim 28, wherein the control means makes the coin releasing means repeat the operation of releasing a maximum number of coins temporarily holdable in the temporarily holding mechanism regardless of the presence or absence of the coins temporarily held in the temporarily holding mechanism.

33. The coin handling device according to claim 28, wherein the control means makes the coin releasing means perform a predetermined number of releasing operations regardless of the presence or absence of the coins temporarily held in the temporarily holding mechanism.

* * * * *